US006353051B1

(12) United States Patent
Huang

(10) Patent No.: US 6,353,051 B1
(45) Date of Patent: Mar. 5, 2002

(54) TOP COATING FOR SYNTHETIC LEATHERS

(75) Inventor: Hsu-Nan Huang, Newark, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/495,132

(22) Filed: Jan. 31, 2000

Related U.S. Application Data

(60) Provisional application No. 60/123,601, filed on Mar. 10, 1999.

(51) Int. Cl.[7] ..... C08L 27/12; C08L 43/00; B05D 5/08

(52) U.S. Cl. ..... 524/544; 524/535; 524/567; 524/568; 252/8.61; 252/8.62; 427/393.5

(58) Field of Search ..... 524/507, 535, 524/544, 567, 568; 252/8.61, 8.62; 427/393.5

(56) References Cited

U.S. PATENT DOCUMENTS

| | | | | |
|---|---|---|---|---|
| 3,824,126 | A | | 7/1974 | Katsushima et al. |
| 3,919,183 | A | | 11/1975 | Jager et al. |
| 4,742,140 | A | | 5/1988 | Greenwood et al. |
| 4,997,873 | A | | 3/1991 | Suling et al. |
| 5,093,398 | A | | 3/1992 | Rottger et al. |
| 5,115,013 | A | | 5/1992 | Rottger et al. |
| 5,143,991 | A | | 9/1992 | Amimoto et al. |
| 5,164,252 | A | * | 11/1992 | Henning et al. |
| 5,344,903 | A | | 9/1994 | Raiford et al. |
| 5,725,789 | A | | 3/1998 | Huber et al. ..... 252/8.62 |

FOREIGN PATENT DOCUMENTS

| | | | |
|---|---|---|---|
| EP | 0 195 714 B1 | 12/1988 | |
| JP | 605168 | 4/1930 | ..... C08F/220/22 |
| JP | 53050077 A | 5/1978 | ..... B29C/1/02 |
| JP | 59101319 A | 6/1984 | ..... B09C/1/02 |
| JP | 59219380 A | 12/1984 | ..... B01J/13/00 |
| JP | 61291677 A | 12/1986 | ..... C09K/3/18 |
| JP | 02145877 A | 6/1990 | ..... D06N/3/14 |
| JP | 03256310 A | 11/1991 | ..... C08F/20/22 |
| JP | 04080218 A | 3/1992 | ..... C08F/220/22 |
| JP | 04080219 A | 3/1992 | ..... C09K/3/18 |
| JP | 05214198 A | 8/1993 | ..... C08L/33/16 |
| JP | H5-339519 | 12/1993 | ..... C09D/5/00 |
| JP | 926770 | 7/1999 | ..... C08F/220/24 |
| WO | WO9607709 A | 3/1996 | ..... C09K/3/00 |

* cited by examiner

*Primary Examiner*—Tae H. Yoon

(57) ABSTRACT

The present invention comprises a composition for coating synthetic grain leather having both dynamic water repellency and oil repellency comprising a copolymer or blend of copolymers and a polyurethane resin in solvent.

9 Claims, No Drawings

TOP COATING FOR SYNTHETIC LEATHERS

This Application claims benefit of Prov. No. 60/123,601 filed Mar. 10, 1999.

BACKGROUND OF THE INVENTION

Synthetic grain leather generally comprises three layers, a base resin-treated fabric substrate, a skin layer containing resin and optional additives such as pigments, and a top coating. The resins are poly(vinyl chloride), or more preferably polyurethane. Such polyurethane grain leathers are described by Sugawara in Kokai Patent No. Sho 54(1979)-18991 and by Civardi and Hutter in the Kirk-Othmer Encyclopedia of Chemical Technology, Vol. 14, pp. 231–249, (John Wiley & Sons, Inc., New York N.Y., 1981, ISBN 0-471-02067-2) under "Leatherlike Materials." While the top coatings for polyurethane synthetic leathers can be prepared from either water-based or solvent-based polyurethane resins, the molecular weight of the water-based polyurethane resin is typically much lower than for solvent-based polyurethane resin. Therefore, the physical properties of water-based polyurethane top coatings are less suitable for synthetic leather applications than are the physical properties of top coatings made from solvent-based polyurethane resins. Solvent-based polyurethane resins are consequently the main materials for the manufacture of synthetic leathers.

Solvent-based polyurethane resins are widely used in the manufacture of man-made grain leather materials. Such synthetic leather materials are used to fabricate a wide range of consumer products, including such items as clothing, shoes, and accessories. In such uses, a high level of oil and water repellency is desirable. The oil repellency provides soil resistance.

In the prior art, a number of methods have been developed to improve physical water resistance, and thus the hydrolysis resistance, of polyurethane-based grain leathers. Such methods are discussed by Sugawara (op. cit.), Civardi and Hutter (op. cit.), Koniki in Japanese Examined Patent Application Publication (Kokoku) No; Heisei 4-53, 985, and by Tonelli and Simeone in U.S. Pat. No. 5,410,010. Typically, these treatments comprise the application of a top coating to the skin layer of the synthetic grain leather. The top coatings have included the coating of the material with formulations containing silicones, hydrocarbon waxes, or fluorochemicals. Silicone and hydrocarbon wax coatings provide negligible oil repellency and soil resistance. Mixtures of water-based fluoropolymer resin dispersions and water-based polyurethane resin emulsions have been coated on the skin layer of synthetic grain leather to improve water resistance (Sugawara, op. cit.). The function of these prior art coatings has been to improve hydrolysis resistance.

A particular type of water resistance not provided by prior art compositions is desirable, termed "dynamic water repellence." Dynamic water repellence, further defined below, is a characteristic property that allows the surface to both resist wetting and to shed water rapidly. The practical advantage of this property is that rain, or splashed water, is immediately shed and the surface of the article retains the attractive glossy surface of the grain leather. It should be noted that there is a major difference between hydrolysis resistance, a surface property intended to preserve the properties of the synthetic leather itself, and dynamic water repellence, a surface property that causes water to be shed rapidly from the surface and provides hydrolysis resistance and a desirable esthetic property.

It is desirable to have an improved solvent-based polyurethane top coating that simultaneously maintains good oil repellency but also provides a high level of dynamic water repellency for use in the manufacture of synthetic grain leather. The present invention provides such a top coating composition.

SUMMARY OF THE INVENTION

The present invention comprises a composition for coating synthetic grain leather comprising:1) i) a copolymer in solvent prepared by polymerization of at least one monomer A, at least one monomer B, and at least one monomer selected from the group consisting of monomer C, monomer D and monomer E, ii) a blend of at least two of said copolymers, or iii) a blend of at least one of the above copolymers with at least one copolymer formed from at least one monomer A, at least one monomer C, and at least one monomer selected from the group consisting of monomer D and monomer E wherein monomer A is selected from the group consisting of Formula A1, Formula A2, and Formula A3, or a mixture thereof, wherein Formula A1 is $$MO[(CHR^1)_x(CH_2)_yO]_z—(CH_2)_w—(T)_v—C(O)—CR=CH_2 \quad \text{(Formula A1)}$$

wherein

M is H or $CH_3(CH_2)_r$—, where r is 0 to 5, (x+y) is 2 to 6 wherein x is zero or a positive integer and y is a positive integer, $R^1$ is hydrogen, fluorine, or an optionally halogenated $C_1$ or $C_2$ alkyl group, such as ethyl, methyl, chloromethyl, z is 3 to 22 or mixtures thereof, v is 0 or 1, w is 0 to 6, provided that when w is 0, v is 0;

T is —O— or —$NR^2$—, wherein $R^2$ is $CH_3(CH_2)_q$ and q is 0 to 4, and

R is hydrogen or a $C_1$–to $C_4$ alkyl group, and preferably hydrogen or methyl;

Formula A2 is $$(R^3R^4)N—(CH_2)_b—A—C(O)—CR=CH_2 \quad \text{(Formula A2)}$$

wherein $R^3$ and $R^4$ are independently $C_1$ to $C_4$ alkyl, hydroxyethyl, benzyl, or $R^3$ and $R^4$ together with the nitrogen atom form a ring structure morpholine, pyrrolidine or piperidine.

b is 2 to 8 or mixtures thereof,

A is —O— or —$NR^2$—, wherein $R^2$ is as defined above, and

R is as defined above; and

Formula A3 is $$X^{-+}N(R^3R^4R^5)—(CH_2)_b—A—C(O)—CR=CH_2 \quad \text{(Formula A3)}$$

wherein $R^5$ is H, $C_1$ to $C_4$ alkyl, $R^3$ and $R^4$ are as described above, or $R^3$, $R^4$ and $R^5$ together with the nitrogen atom form an aromatic ring pyridine, X is a chloride, bromide, hydroxide, sulfate or carboxylate anion, and b, A, and R are as described above;

monomer B is a linear or branched fluoroalkyl (meth) acrylate of Formula B $$C_gF_{(2g+1)}—Z—O—C(O)—CR=CH2 \quad \text{(Formula B)}$$

wherein g is 4 to 20 or mixtures thereof,

R is as previously defined, and

Z represents the grouping $$—(CH_2)_h—, \quad —O—(CH_2)_h—, \text{ or}$$

$$—SO_2—\underset{\underset{R^6}{|}}{N}—CH_2—\underset{\underset{R}{|}}{CH}—$$

wherein h is 1 to 4, and

R is as previously defined, and $R^6$ is a $C_1$ to $C_4$ alkyl group;

monomer C is selected from the group consisting of Formula C1 and Formula C2, or a mixture thereof, wherein Formula C1 is $$C_pH_{(2p+1)}—T—C(O)—CR=CH_2 \quad \text{(Formula C1)}$$

wherein p is 4 to 22 or mixtures thereof,

R and T are as previously defined; and

Formula C2 is $$R^6—[Si(R^6R^7)—O]_m—[Si(R^6)_2—O]_n—[(CH2)_d—O]_e—C(O)—CR=CH_2 \quad \text{(Formula C2)}$$

wherein each $R^6$ is independently a $C_1$ to $C_4$ alkyl group, $R^7$ is $R^6$ or a $C_1$ to $C_{20}$ halogenated alkyl group, (m+n) is 4 to 40 wherein m is zero or a positive integer and n is a positive integer, d is 0 to 8, e is zero or 1, provided that when d is zero, e is zero, and R is as defined above;

monomer D is a cross-linking agent;

monomer E is vinyl chloride or vinylidene chloride; and 2) a polyurethane resin in solvent The present invention further comprises a method of treating synthetic grain leather comprising application to the top surface thereof an effective amount of a composition as described above.

The present invention further comprises a synthetic grain leather treated in accordance with the method of the present invention.

DETAILED DESCRIPTION OF THE INVENTION

The top coating composition of the present invention comprises a copolymer, prepared, for instance, by aqueous emulsion polymerization in the presence of a surfactant, dispersed in a solvent or solvent mixture, and mixed with a solution of a polyurethane resin in a solvent. The top coating typically has high compatibility with the solvent-based polyurethane substrate onto which it is applied. The present invention further comprises a method of treating synthetic grain leather comprising application of a top coating composition of this invention to a pre-formed synthetic grain leather made from solvent-based polyurethane or from poly (vinyl chloride), and drying and curing the top coating. The invention further comprises such top coated substrates. The present invention is intended for use on synthetic grain leathers with a grain finish, and not for synthetic leathers with suede finishes.

The top coating composition of the present invention provides dynamic water repellency while maintaining good oil repellency. The term "dynamic water repellency" is used herein to mean the ability of the treated surface to both resist water wetting and to shed water rapidly. A cured sample of a top coating of the present invention on a glass or synthetic leather surface passes the requirements of Test Method 2. The top coated synthetic leathers of this invention have an oil repellency rating number of a least 1 when measured by Test Method 1. Both test methods are described hereinafter.

The hardness and surface texture of different samples of synthetic leather can affect the test results for dynamic water repellency. For consistent screening and evaluation purposes, the top coating materials of this invention are coated onto a smooth clean glass surface and cured with heat. Oil resistance and dynamic water repellency measurements are then measured while the coating remains on the glass. Subsequently, selected coatings are tested on synthetic leather samples.

The terms "(meth)acrylate" and "(meth)acrylates" as used herein include both acrylates and methacrylates.

The top coating of this invention comprises a physical mixture of Top Coat Components 1 and 2. Top Coat Component 1 comprises an emulsion copolymerization product and added solvent, typically dimethylformamide (hereinafter "DMF"). Top Coat Component 2 comprises a polyurethane resin solution, typically in DMF.

Top Coat Component 1 is a copolymer in solvent prepared by polymerization of at least one monomer A; at least one monomer B; and at least one monomer selected from the group consisting of monomer C, monomer D, and monomer E; or a blend of said copolymers. Top Coat Component 1 alternatively is a blend of at least one of the above copolymers with at least one copolymer formed from at least one monomer A, at least one monomer C, and optionally at least one of monomer D or monomer E. All monomers are defined below.

Top Coat Component 2 comprises a polyurethane resin in solvent. Components 1 and 2 are present in a ratio of about 1:1 in the final top coating composition.

The monomers of Monomer Groups A–E are copolymerized conventionally (e.g., as described in U.S. Pat. No. 3,491,169), for instance, in an aqueous emulsion utilizing selected surfactant(s). After polymerization, the copolymerization product containing water and surfactant is simply mixed with a solvent or solvent mixture compatible with solvent-based polyurethane solutions to give a homogeneous dispersion termed Top Coat Component 1.

Suitable monomers to improve the compatibility of the copolymer with DMF (Monomer Group A) are selected from monomers having the structure of Formulae A1, A2, A3, or mixtures thereof:

$$MO[(CHR^1)_x(CH_2)_yO]_z—(CH_2)_w—(T)_v—C(O)—CR=CH_2 \quad \text{(Formula A1)}$$

wherein

M is H or $CH_3(CH_2)_r$—, where r is 0 to 5, (x+y) is 2 to 6 wherein x is zero or a positive integer and y is a positive integer, $R^1$ is hydrogen, fluorine, or an optionally halogenated $C_1$ or $C_2$ alkyl group, such as ethyl, methyl, chloromethyl, etc., z is 3 to 22 or mixtures thereof, v is 0 or 1, w is 0 to 6, provided that when w is 0, v is 0; and T is —O— or —$NR^2$—, where $R^2$ is $CH_3(CH_2)_q$ and q is 0 to 4, and R is hydrogen or a $C_1$— to $C_4$ alkyl group, and preferably hydrogen or methyl, $$(R^3R^4)N—(CH_2)_b—A—C(O)—CR=CH_2 \quad \text{(Formula A2)}$$

wherein $R^3$ and $R^4$ are independently $C_1$ to $C_4$ alkyl, hydroxyethyl, benzyl, or $R^3$ and $R^4$ together with the nitrogen atom form a ring structure morpholine, pyrrolidine or piperidine.

b is 2 to 8 or mixtures thereof,

A is —O— or —$NR^2$—, where $R^2$ is as defined above, and

R is as defined above;

$$X^{-+}N(R^3R^4R^5)—(CH_2)_b—A—C(O)—CR=CH_2 \quad \text{(Formula A3)}$$

wherein $R^5$ is H, $C_1$ to $C_4$ alkyl and $R^3$ and $R^4$ are as described above or $R^3$, $R^4$ and $R^5$ together with the nitrogen atom form an aromatic ring pyridine, X is a chloride, bromide, hydroxide, sulfate or carboxylate anion, and b, A, and R are as described above.

Preferred monomers of the structure of Formula A1 are monomers wherein x is 2, y is 0, z is 5 to 10, and R is hydrogen or methyl.

Preferred monomers of the structure of Formula A2 are monomers wherein R is methyl, A is oxygen, b is 2, and $R^3$ and $R^4$ are ethyl.

Preferred monomers of the structure of Formula A3 are monomers wherein R is methyl, A is oxygen, b is 2, $R^3$ and $R^4$ are ethyl, $R^5$ is methyl, and X is chloride.

Suitable monomers of Group B are linear or branched fluoroalkyl (meth)acrylate monomers of Formula B:

$$C_gF_{(2g+1)}—Z—O—C(O)—CR=CH2 \quad \text{(Formula B)}$$

wherein g is 4 to 20 or mixtures thereof,

R is as previously defined, and

Z represents the grouping $$—(CH_2)_h—, \quad —O—(CH_2)_h—, \text{ or}$$

$$—SO_2—\underset{\underset{R^6}{|}}{N}—CH_2—\underset{\underset{R}{|}}{CH}—$$

in which h is 1 to 4, and

R is as previously defined, and $R^6$ is a $C_1$ to C4 alkyl group.

Preferred fluoroalkyl (meth)acrylates of Group B are fluoroalkyl (meth)acrylates in which g is 4 to 14, Z is —$(CH_2)_2$—, and R is hydrogen or methyl, or mixtures of such fluoroalkyl (meth)acrylates.

Suitable monomers of Group C are monomers of Formula C1 or C2 or mixtures thereof. Suitable monomers of Formula C1 are linear or branched hydrocarbon (meth) acrylates:

$$C_pH_{(2p+1)}—T—C(O)—CR=CH_2 \quad \text{(Formula C1)}$$

wherein p is 4 to 22 or mixtures thereof,

R and T are as previously defined;

Suitable monomers of Formula C2 are silicon-containing (meth)acrylates, or mixtures thereof:

$$R^6—[Si(R^6R^7)—O]_m—[Si(R^6)_2—O]_n—[(CH2)_d—O]_e—C(O)—CR=CH_2 \quad \text{(Formula C2)}$$

wherein $R^6$ is a $C_1$ to $C_4$ alkyl group and each $R^6$ is the same or different, $R^7$ is $R^6$or a $C_1$ to $C_{20}$ halogenated alkyl group, (m+n) is 4 to 40 wherein m is zero or a positive integer and n is a positive integer, d is 0 to 8, e is zero or 1, provided that when d is zero, e is zero, and R is as defined above.

Preferred hydrocarbon (meth)acrylates of Group C1 are stearyl methacrylate and stearyl acrylate. Preferred silicon-containing (meth)acrylates of formula C2 are monomers where d is 3, e is 1, m is 0, n averages 25, and $R^6$ is methyl.

Optional monomers of Group D are cross-linking agents and function to improve cross-linking within the top coating and between the top coating and the skin layer of the substrate, thereby improving the physical properties and top coat adhesion. Preferred optional monomers of Group D are hydroxyethylmethacrylate, N-methylolacrylamide and N-methylolmethacrylamide. Other conventional monomers to provide cross-linking are also suitable for use herein.

Optional monomers of Group E function to improve the oil repellency of the top coat as described by Greenwood, et al., in U.S. Pat. No. 4,742,140. Preferred optional monomers of Group E are vinyl chloride and vinylidene chloride. Other conventional monomers to enhance oil repellency are also suitable for use herein.

The weight ratios of the monomers of Groups A–E are 1 to 15% and preferably 1 to 3% of the monomer of Group A; 10 to 85% and preferably 45 to 80% of the monomer of Group B; 0 to 50% of the monomer from Group C, and preferably 15 to 30%; 0 to 3% and preferably 0.5 to 2% of the optional monomer of Group D; and 0 to 40% and preferably 15 to 25% of the monomer of Group E.

To control the molecular weight of the resulting copolymers, small amounts of a conventional chain-terminating agent, such as an alkanethiol of 4–18 carbon atoms, can be present during the copolymerization. The effect of excessive copolymer molecular weight is discussed below in connection with the top coating application and curing.

Surfactants are used in the aqueous emulsion copolymerization of monomers of Groups A–E. It is important that such surfactants do not have high solubility in the DMF solvent. If the surfactant does have too high a solubility in DMF, the copolymer emulsion will coagulate when the solvent, such as DMF, is added. Preferred surfactants are a stearic acid/14-ethylene oxide adduct, a N,N-dimethyldodecylaminelacetic acid adduct, and an ethoxylated carboxylated octadecylamine. The composition of the aqueous copolymer emulsion is approximately 28.7% by weight copolymer, 1.3% surfactant, and 70% water, with a solids content of approximately 30% by weight.

Suitable solvents for the dispersion of the copolymerization product are DMF and mixtures of DMF with up to 30 weight % of one or more of the commonly used solvents for synthetic leather manufacture, such as N,N-dimethylacetamide (hereinafter DMAC), methylisobutylketone, toluene, and methylethylketone. Preferred are DMF, DMF and toluene mixture, or DMF and methylethylketone mixture.

Dispersions of the copolymerization product in the solvent are prepared by simply mixing the aqueous emulsion of copolymer with the solvent. The amount of solvent used is approximately equal to the weight of the copolymer emulsion. This mixture of copolymer emulsion and solvent is the Top Coat Component 1. The amounts of solvent used in Top Coat Components 1 and 2 can be adjusted to facilitate the application of the top coat formulation.

The Top Coat Component 1 copolymers of the present invention can be made by other methods as will be obvious to those skilled in the art. For instance, the copolymers of Top Coat Component 1 can be prepared in organic solvents, such as methylisobutylketone, acetone, ethyl acetate, DMF, or isopropanol. The organic solution can then be diluted with DMF to provide the Top Coat Component 1. Alternatively, the copolymer of Top Coat Component 1 prepared in an organic solvent can be emulsified with water and the polymerization solvent stripped off to leave an aqueous copolymer emulsion, which, after dilution with DMF, provides the Top Coat Component 1.

Top Coat Component 2 comprises a solution of polyurethane resin dissolved in a suitable solvent. The suitable solvents for Top Coat Component 2 are as for Top Coat Component 1. Preferred are DMF, a mixture of DMF and toluene, and a mixture of DMF and methylethylketone. Top Coat Component 2 contains approximately 30% by weight of polyurethane resin. As indicated above for Top Coat Component 1, the amount of solvent used in Top Coat Component 2 similarly can be adjusted to facilitate the application of the top coat formulation. Suitable polyurethane resins for Top Coat Component 2 are film-forming polyurethane resins, soluble to at least about 25% by weight in DMF or in a mixture of DMF and other solvent and providing a 25% solution having a viscosity in the range of 100 to 100,000 cP (0.1 to 100 Pa-sec) at 22° C. Preferred is a polyurethane resin having a solids content of about 30% in a solvent mixture of 30% by weight methylethylketone and 70% by weight DMF, and having a viscosity of from about 500 to 900 Pa-sec at 20° C. Also preferred is for the polyurethane resin to have 100% modulus of from about 80 to about 90 kg/cm$^2$, a tensile strength at break of more than 550 kg/cm$^2$, an elongation at break of more than about 350% and a softening temperature of about 170 to 180° C.

The final top coating is prepared by slowly pouring Top Coat Component 1 into Top Coat Component 2 with slow agitation. A suitable and preferred agitator is a high efficiency paddle for highly viscous liquids and semisolids (available as Catalogue Item Z26,660-4 from Aldrich, Milwaukee Wis.), set to run at about 80 rpm. If the agitation is too fast, the polyurethane will coagulate around the agitator blades. The weight proportions of Top Coat Component 1 to 2 depends on the desired combination of glossy appearance, dynamic water repellence, oil repellence, durability, and physical properties of the finished synthetic grain leather. A higher ratio of Top Coat Component 1 increases the dynamic water repellence and oil repellence of the top coating film but may adversely affect the gloss and homogeneity of the cured coating. A lower ratio of Top Coat Component 1 increases the glossiness and tensile strength of the top coating film but may adversely affect the oil and dynamic water repellency of the cured coating. While it can be seen that, for a specific application, the ratio is necessarily adjusted for an optimum balance of properties, a generally preferred proportion between Top Coat Component 1 and 2 is that which will provide between 0.018 and 0.12 parts by weight of the copolymer or copolymers of Top Coat Component 1 per part by weight of polyurethane, and most preferably between 0.025 and 0.09 parts by weight of the polymer of Top Coat Component 1 per part by weight of polyurethane.

Expressed in terms of percentage, the generally preferred proportion between Top Coat Component 1 and 2 is that which will provide in the dried and cured top coating (i.e., based on the non-volatile content of the top coating) a composition containing between 1.8 and 10.7% of the copolymer or copolymers of Top Coat Component 1 and 98.2 to 89.3% of the polyurethane resin of Top Coat Component 2. Most preferably, the said percentage proportions will be between 2.4 and 8.3% of the copolymer or copolymers of Top Coat Component 1 and 97.6 to 91.7% of the polyurethane resin of Top Coat Component 2. The mixed Top Coat Components 1 and 2 comprise the top coating formulation of this invention. As indicated above, the amount of solvent in the top coating can be adjusted to facilitate the application of the coating.

Preferred top coating compositions of the present invention include those wherein the copolymer of component 1 is prepared by polymerization of at least one monomer of Formula A1, at least one monomer of Formula B, at least one monomer of Formula C1, and at least one monomer of Formula D. Also preferred is the above composition further comprising in component 1 at least one monomer of Formula E.

The present invention further comprises a method of treating synthetic grain leather comprising application of a top coating composition of the present invention as defined above to the top surface of a pre-formed synthetic grain leather, and a synthetic grain leather substrate so treated. The top coating formulation is applied to either polyurethane or poly(vinyl chloride) synthetic grain leather by conventional top coating methods such as spray or knife coating. The choice of the coating process depends on the viscosity of the top coating formulation, and thus on the total solids content of the top coating formulation and the molecular weight of the polyurethane used in Top Coat Component 2. In order to increase the durability of the coating, a small amount of an additional cross-linking agent can be added to the top coating formulation before coating. An example of such an added cross-linking agent is melamine, added in an amount of up to 0.3% by weight based on the total weight of the top coating as applied. The top coating is applied in an amount sufficient to provide a dried and cured coating that is free of pinholes or starved areas. This requirement is met by applying the top coating in an amount sufficient to produce a dried and cured top coating of not less than 8 g/m$^2$, and preferably about 40 g/m$^2$. Typically, this is obtained by applying 3 mil (0.08 mm) thickness of the wet top coat. It will be recognized by those skilled in the art that coatings thinner than the suggested ranges progressively increase the risk of an incomplete coating and thicker coatings increase cost without commensurate benefits.

The coated leather is then heated in an oven to dry and cure the coating. Coatings on glass are placed immediately in an oven at 125–130° C. for 40–60 minutes. Coatings on synthetic leather prepared in the laboratory are allowed to air dry for about 8 hours to remove most of the solvent, then heated for 5–10 minutes at 125–130° C. The laboratory drying process for synthetic leather can be shortened by the use of a temperature-programmed oven whereby the temperature is gradually increased as the DMF or other solvent is removed. Immediate exposure of the freshly coated synthetic leather to the final cure temperature, or to a temperature gradient that is too steep, can cause the quality of the coating to deteriorate. Adjustment of cure temperatures for coatings on synthetic grain leathers is well known to those skilled in the art.

Production line coatings are dried in, for instance, a continuous-feed oven that provides a temperature gradient and with the temperature gradient adjusted to complete the cure without excessively rapid heating. Control of the temperature gradient in such facilities is well known to those skilled in the art.

The present invention further comprises a synthetic grain leather top coated with the coating composition as described above. Synthetic leathers treated with the top coat of this invention have a receding water contact angle of at least 80° after drying and curing. The measurement of the receding water contact angle is described in Test Method 3 below. The cure temperature and time should be adjusted to produce a cured coating with a receding water contact angle of not less than 80°. The 80° contact angle is measured whether the top coating has been applied to a glass or synthetic grain leather surface. The cure temperature should be adjusted carefully based on the thermal stability of the synthetic grain leather substrate and the top coating layer.

As indicated above, a chain-limiting agent such as a $C_4$–$C_8$ alkanethiol, can be included in the emulsion copolymerization to limit molecular weight. Increased molecular weight of the copolymer results in an increase in the combination of cure temperature and curing time necessary to generate a receding water contact angle of greater than 80°. The stability of the substrate and coating clearly limits the extent to which curing temperature and duration can be increased. The severity of the curing conditions can be reduced to approximate the suggested cure described above by reducing the copolymer molecular weight. Increasing the amount of the chain-limiting agent in the emulsion polymerization step reduces the copolymer molecular weight.

The use of DMF as the preferred major solvent component for the top coating enhances the compatibility of the top coating with the substrate synthetic leather since the substrate itself utilizes a DMF based polyurethane in its manufacture.

The top coating composition and method of the present invention are useful to treat synthetic grain leather to provide dynamic water repellency and oil repellency. The advantage of the treated leather surface of immediately shedding water is desirable for many products made from the leather. The treated leather of the present invention is useful in many traditional applications in a wide range of consumer products such as clothing, shoes, luggage, purses, accessories and other items.

Test Methods

Test Method 1. Measurement of Oil Repellency

Coated glass and coated synthetic grain leather samples were tested for oil repellency by a modification of the American Association of Textile Chemists and Colorists (AATCC) Standard Test Method No. 118, conducted as follows. A series of organic liquids, identified below in Table 1, were applied drop-wise to the coated samples. Beginning with the lowest numbered test liquid (Test Liquid for Repellency Rating 1), one drop (approximately 5 mm in diameter or 0.05 mL) was placed on each of three locations at least 5 mm apart. The drops were observed for 30 seconds. If, at the end of this period, at least two of the three drops were still spherical to hemispherical in shape, three drops of the next higher numbered liquid were placed on adjacent sites and similarly observed for 30 seconds. The procedure was continued with progressively higher numbered test liquids until a test liquid resulted in two or more of the drops failing to remain spherical to hemispherical. The oil repellency rating of the sample is the number of the highest numbered liquid for which at least two of the three drops remained spherical to hemispherical for 30 seconds.

TABLE 1

Oil Repellency Test Liquids.

| Oil Repellency Rating Number | Test Solution |
|---|---|
| 1 | NUJOL purified mineral oil* |
| 2 | 65/35 NUJOL/n-hexadecane by volume |
| 3 | n-hexadecane |
| 4 | n-tetradecane |
| 5 | n-dodecane |
| 6 | n-decane |

*Available from Schering-Plough, Inc., Memphis TN.

Test Method 2. Measurement of the Dynamic Water Repellency

The dynamic water repellency was measured by a modification of the American Association of Textile Chemists and Colorists (AATCC) Spray Tester Standard Test Method No. 22-1996. The back face of a smooth glass sheet, 10 by 12.5 cm, was marked with three lines across the 10 cm width of the glass, at 1.5 cm (line 1), 3 cm (line 2), and 9.5 cm (line 3) from the top edge. The top coating formulation to be tested was coated on the front face of the glass using a coating knife with an opening of 3 mil (0.08 mm). The coated glass was heated in an oven at 125–130° C. for 60 minutes and allowed to cool to room temperature.

The coated glass was mounted in the Spray Tester, sloping down from the top edge at 45°, in the location where the fabric sample would normally be mounted in AATCC Test Method No. 22-1996 and the six-inch (15.2 cm) funnel replaced by a 25-ml titration burette. The outside diameter of the burette tip was 0.635 mm, to provide droplets of approximately 0.1 mL, and the vertical distance between the burette tip and the coated glass sheet was 4 in. (10.16 cm). The titration burette was charged with 25 ml distilled water at 27 plus or minus 1° C. The water was adjusted to flow dropwise from the burette at a rate of 80 plus or minus 5 drops per minute and the drops strike the coated surface of the glass plate between lines 1 and 2. The drops bounce or roll down the coated surface and across line 3. A coating is deemed to "pass" the dynamic water repellency test if the drop of water bounced or rolled across line 3 without leaving a wet streak and before the next water drop hits the coated surface. A "borderline" rating is given if a few small spherical drops remain spattered on the sample but most of the water is shed from the sample within the specified interval. A "fail" rating is given if more than one quarter of the droplet path between lines 2 and 3 remains marked by spattered drops, or if the drop leaves a wet trace. Five observations are made and averaged.

Test Method 3. Measurement of the Water Contact Angle

Contact angles are measured by the Sessile Drop Method which is described in A. W. Adamson, "The Physical Chemistry of Surfaces", Fifth Edition, Wiley & Sons, New York, 1990. Additional information on the equipment and procedure for measuring contact angles is provided by R. H. Dettre et al. in "Wettability", Ed. by J. C. Berg, Marcel Dekker, New York, 1993.

In the Sessile Drop Method, a Ramé-Hart optical bench is used to hold the substrate in the horizontal position. The contact angle is measured with a telescoping goniometer from the same manufacturer. A drop of test liquid is placed on a surface and the tangent is precisely determined at the point of contact between the drop and the surface. The receding angle is determined by decreasing the size of the drop of liquid.

The relationship between liquid contact angles and the wettability of surfaces is described in A. W. Adamson, above. In general, higher water contact angles are indicative that a surface has greater water repellency.

Materials

The following materials are used in the examples hereinafter. Trade names are indicated by upper case.

Mixed perfluoroalkylethyl acrylates are available as ZONYL TA-N fluorotelomer intermediate from E. I. du Pont de Nemours and Co., Wilmington Del.

Mixed perfluoroalkylethyl methacrylates are available as ZONYL TM fluorotelomer intermediate from E.I. du Pont de Nemours and Co., Wilmington Del.

VAZO 56 WSW [2,2'-azobis(2-amidinopropane) dihydrochloride], VAZO 64 [azobis(isobutyronitrile)], and azobis(isobutyrmidine) dihydrochloride initiators are available from E.I. du Pont de Nemours and Co., Wilmington Del.

Stearyl methacrylate, N-methylolacrylamide, hexadecylmercaptan, 2-ethylhexyl acrylate and dodecylmercaptan are available from Pfaltz & Bauer, Inc., Waterbury Conn.

Hydroxyethyl methacrylate is available from I & K Rare and Fine Chemicals, Costa Mesa Calif.

Poly(oxyethylene)7 methacrylate is available from Sartomer Co., West Chester Pa.

N,N-diethylaminoethyl methacrylate is available from E.I. du Pont de Nemours and Co., Wilmington Del.

X-24-8201 is a proprietary modified organopolysiloxane with the structure of Formula C2, available from ShinEtsu Company, Tokyo, Japan.

EXAMPLES

In the Examples, monomers are identified in parenthesis by Groups A–E, for example as [B] for a monomer B.

Example 1

A water emulsion was prepared by melting the ZONYL TA-N to 50° C., warming the water to the same temperature, and combining the following ingredients in a plastic beaker:

59.0 g ZONYL TA-N mixed perfluoroalkylethyl acrylates [B], 16.0 g stearyl methacrylate [C1], 1.0 g stearic acid/14-ethylene oxide adduct [A1], 3.0 g lauryl alcohol/16-ethylene oxide adduct [A1], 50.0 g ethylene glycol, and 100.0 g deionized water.

The mixture was ultrasonically emulsified for 4 minutes, using a Model W-385 Sonicator from Heat Systems Ultrasonics, Inc., Farmingdale N.Y. The emulsion was transferred, using an additional 70 mL deionized water, to a 500-cc glass reaction vessel equipped with an agitator, a thermometer, and a dry-ice condenser, and containing:

1.0 g N-methylolacrylamide [D], 0.5 g hexadecylmercaptan, 1.0 g hydroxyethyl methacrylate [D], and 2.0 g poly(oxyethylene)$_7$ methacrylate [A1].

The resulting mixture was purged with nitrogen gas at 60° C. for one hour to remove substantially all air. The nitrogen purge was then switched to a positive pressure nitrogen blanket and 25.0 g vinylidene chloride [E] were added. To initiate polymerization, 1.0 g azobis(isobutyramidine) dihydrochloride was added. The resulting mixture was then heated to 50° C. over one hour and held at 50° C. for 15 hours. The polymer latex was filtered through a milk filter cloth, a fine nylon cloth of approximately 80 mesh (~30 cm$^{-1}$), to remove lumps. The resulting polymer latex weighed 320 g and had a solids content of 32%.

A portion of the copolymer emulsion was added with mixing to an equal weight of DMF to give a homogeneous dispersion designated Top Coat Component 1. 770 g of Top Coat Component 2 (a solution of polyurethane resin containing 30% by weight resin in a solvent mixture of 30% methylethylketone and 70% DMF and having a viscosity of 500 to 900 Pa-sec. at 20° C., a 100% modulus of 80 to 90 kg/cm$^2$, a tensile strength at break of more than 550 kg/cm$^2$, an elongation at break of more than 350%, and a softening temperature of 170 to 180° C.) was placed in a wide-mouthed glass reactor. The reactor was equipped with a dropping funnel and a motor-driven high-efficiency mixing paddle for highly viscous liquids (available as Catalogue Item Z26,660-4 from Aldrich, Milwaukee Wis.), set to run at about 80 rpm. 130 g. of Top Coat Component 1 were slowly added into the glass reactor from the dropping funnel to provide the top coating formulation for copolymer CP1.

Example 2

A water emulsion was prepared by mixing the following:

60.0 g of ZONYL TM mixed perfluoroalkylethyl methacrylates [B], 20.0 g of 2-ethylhexyl acrylate [C1], 1.0 g of N-methylolacrylamide [D], 1.0 g of 2-hydroxyethyl methacrylate [D], 2.0 g 2-hydroxyethyl methacrylate/7-ethylene oxide adduct [A1], 8 g of stearic acid/14ethylene oxide adduct [A1], 0.5 g of dodecylmercaptan, 20.0 g hexylene glycol, and 200.0 g deionized water.

The emulsion was added to a glass reaction vessel equipped with an agitator, a thermometer, and a dry ice condenser. The mixture was purged at 60° C. with nitrogen gas for one hour, and then the nitrogen purge was switched to a positive pressure nitrogen blanket. To the aqueous monomer emulsion were added 20.0 g of vinylidene chloride [E] and 1.0 g 2,2'-azobis(2-amidinopropane) dihydrochloride (VAZO 56 WSW) dissolved in 10.0 g deionized water to initiate the polymerization. The resultant mixture was heated to 50° C. and held at 50° C. for 8 hours. The polymerization yielded a polymer latex. The resulting polymer latex weighed 342 g and had a solids content of 32%.

A portion of the copolymer emulsion was sequentially mixed with DMF and a solution of polyurethane resin as described for Example 1 to provide the top coating formulation for copolymer CP2.

TABLE 2

Top Coating Formulations*
Top coating compositions were prepared according to the following formulations.

| Top Coat ID | Copolymer of Component 1 ID | Copolymer % by weight in Emulsion | Top Coat Component 1 Weight Ratio, Copolymer Emulsion to DMF | Copolymer % by weight in Component 1 | Top Coat Formulation Weight % Copolymer in Top Coat | Top Coat Formulation Ratio, Copolymer to PU** Resin in Top Coat |
|---|---|---|---|---|---|---|
| T1 | CP2 | 32 | 0.9:1 | 15.2 | 2.17 | 0.0843:1 |
| T2 | CP2 | 32 | 0.7:1 | 13.3 | 1.9 | 0.0741:1 |
| T3 | CP2 | 32 | 0.6:1 | 10.7 | 1.52 | 0.0593:1 |
| T4 | CP2 | 32 | 0.3:1 | 8.0 | 1.14 | 0.0445:1 |
| T5 | CP2 | 15 | 1:0.2 | 5.0 | 0.71 | 0.0278:1 |

*For each top coating formulation, Top Coat Component 2 contained 30% by weight polyurethane resin dissolved in DMF and the weight ratio of Top Coat Component 1 to Top Coat Component 2 was 1:6. The concentration of the polyurethane resin in each top coat was thus 25.7% by weight.
**Polyurethane is abbreviated PU in the table The top coatings described in Table 2 were variously applied to glass and polyurethane-based synthetic grain leather. The top coatings were applied using a coating knife with an opening of 3 mil (0.08 mm) to produce a 3 mil (0.08 mm) thickness of the wet top coat. Coatings on glass were immediately heated in an oven at 125–130° C. for 40–60 minutes to dry and cure the coating. Coatings on synthetic leather were allowed to air dry for about 8 hours to remove most of the solvent, then heated for 5–10 minutes at 125–130° C. The coated glass and synthetic leather samples were subjected to Test Methods 1–3 and gave the results shown in Table 3.

The results in Table 3 show that (a) the oil repellency, dynamic water repellency, and receding water contact angle measurements correlated; (b) the contact angle increased with the cure duration, and (c) the curing time was reduced by raising the curing temperature.

Example 3

The top coating formulation CP1, prepared as in Example 1, was coated onto a sample of polyvinyl chloride (PVC) synthetic leather instead of polyurethane synthetic leather and tested as for Example 1. The performance results were:

TABLE 3

Top Coat Test Results

| Top Coat ID | Cure Conditions Temp. ° C. | Cure Conditions Heating Period | Test Results on Glass: Oil Repellency Rating Method 1 | Glass: Dynamic Water Repellency Method 2 | Glass: Water Receding Contact Angle Method 3 | Synthetic Leather Method 1 | Synthetic Leather Method 2 | Synthetic Leather Method 3 |
|---|---|---|---|---|---|---|---|---|
| Correlation of Test Results | | | | | | | | |
| T1 | 125 | 60 | 6 | Pass | 113 | 5 | pass | 123 |
| T2 | 125 | 60 | 6 | Pass | 108 | — | — | — |
| T3 | 125 | 60 | 6 | Pass | 102 | — | — | — |
| T4 | 125 | 60 | 5 | Pass | 97 | — | — | — |
| T5 | 125 | 60 | 5 | Pass | 93 | — | — | — |
| Varied Curing Duration | | | | | | | | |
| T4 | 125 | 5 | — | — | 55 | — | — | — |
| T4 | 125 | 10 | — | — | 76 | — | — | — |
| T4 | 125 | 20 | — | — | 73 | — | — | — |
| T4 | 125 | 40 | — | — | 79 | — | — | — |
| T4 | 125 | 60 | — | — | 103 | — | — | — |
| Varied Curing Temperature | | | | | | | | |
| T4 | 150 | 5 | — | — | 67 | — | — | — |
| T4 | 150 | 10 | — | — | 86 | — | — | — |
| T4 | 150 | 20 | — | — | 91 | — | — | — |
| T4 | 150 | 40 | — | — | 98 | — | — | — |

| | |
|---|---|
| Oil repellency (Test Method #1) | 6 |
| Dynamic water repellency (Test Method #2) | Pass |
| Water receding angle (Test Method #3) | 118° |

Example 3 demonstrate the value of the coatings of this invention on PVC synthetic leather.

Example 4

A top coating formulation was prepared according to the procedure of Example 1 except that the monomer C component was 15 g X-24-820 ([C2], see Materials above), and monomer B component was ZONYL TA-N 86 g. Monomer E was omitted, and monomers A and D were as in Example 1. The polymer latex weighed 304 g and had a solids content of 33.4%. The top coating was prepared as in Example 1 and tested on glass. The test results were:

| | |
|---|---|
| Oil repellency(Test Method #1) | 4 |
| Dynamic water repellency (Test Method #2) | Borderline |
| Water receding angle (Test Method #3) | 83° |

Example 4 demonstrated that some silicon containing monomer of the structure of Formula C2 can be used in the copolymer.

Example 5

A top coating formulation was prepared according to the procedure of Example 4 except that the monomer C1 component was stearyl methacrylate 22.5 g, monomer B component ZONYL TA-N 86g, and monomer D was omitted. The polymer latex weighed 286 g and had a solids content of 35.4%. The top coating was prepared as in Example 1 and tested on glass. The test results were:

| | |
|---|---|
| Oil repellency (Test Method #1) | 6 |
| Dynamic water repellency (Test Method #2) | Pass |
| Water receding angle (Test Method #3) | 114° |

Example 5 demonstrated that excellent coatings can be prepared using only monomer components A, B, and C.

Example 6

A top coating formulation was prepared according to the procedure of Example 1 no monomer C component was used, and the monomer B component was ZONYL TA-N 90 g. Monomer E was omitted and Monomers A and D were as in Example 1. The polymer latex weighed 295 g and had a solids content of 31.0%. The top coating was prepared as in Example 1 and tested on glass. The test results were:

| | |
|---|---|
| Oil repellency (Test Method #1) | 6 |
| Dynamic water repellency (Test Method #2) | Pass |
| Water receding angle (Test Method #3) | 113° |

Example 6 demonstrated that Monomer component C is optional.

Comparative Example A

Dimethyloctadecylamine/acetic acid adduct (6.25 g, 0.45% based on weight of monomers [OWM]) was dissolved in 2.37 g water with agitation. Then 1003.4 g (66.5% OWM ZONYL TM [3], and 497.9 g (33.0% OWM) of commercial lauryl methacrylate ([C1], 60% n-dodecyl, 27% n-tetradecyl, 7% lower esters, 6% higher esters, MW 262) were added and homogenized with the aqueous solution. The homogenized mixture was purged with nitrogen at 60° C. for one hour. Water (1650 g) in a separate container was degassed with nitrogen and boiling, then added to the above monomer dispersion. Dodecylmercaptan (2.25 g, 0.15% OWM), 6.28 g (0.25% OWM) of a 60% aqueous solution of N-methylolacrylamide [D], and 3.77 g (0.25% OWM) of 2-hydroxyethyl methacrylate [D] were added, the mixture was heated to 60° C. with agitation, and 1.1 g (0.07% OWM) azobis(isobutyramidine hydrochloride were added. The polymerization initiated and heating at 60–70° C. was continued until complete (4–5 hours). The resulting aqueous dispersion contained approximately 28% solids.

When a portion of the copolymer emulsion was mixed with DMF according to the procedure of Example 1, the copolymer emulsion was incompatible with the solvent, and could not be further tested. The copolymer of Comparative Example C did not contain a monomer of Group A.

Comparative Example B

To 118 parts water at 50–55° C. was added a preformed mixture of 11.8 parts dimethyloctadecylamine and 7.1 parts acetic acid. Then, after mixing is complete, 150 parts ZONYL TM [3] and 50 parts commercial 2-ethylhexyl methacrylate [C1] were added. The resulting mixture is passed twice through a Manton-Gaulin homogenizer at 3000 psig (21,000 kPA).

The resulting emulsion of monomers is purged with nitrogen at 60° C. for one hour, then added to 200 parts air-free deionized water along with 66 parts of water rinse. Then 0.503 parts commercial 2-hydroxyethyl methacrylate [D], 0.840 parts of a 60% by weight aqueous solution of N-methylolacrylamide [D] and from 0.088 to 0.165 parts dodecylmercaptan were added. After the resulting mixture was heated at 65° C. for 0.5 hours, a mixture of 0.08 parts azobis(isobutyramidine) dihydrochloride in 0.25 parts water was added to initiate the polymerization. The temperature was allowed to adjust to 70° C. and the reaction mass was maintained for 4 hours with agitation. The mass was then cooled to ambient temperature, giving an emulsion containing about 25% by weight polymer, the polymer being approximately 75% by weight perfluoroalkylethyl methacrylate units, 25% 2-ethylhexyl methacrylate units, 0.25% 2-hydroxyethyl methacrylate units, and 0.25% N-methylolacrylamide units.

When a portion of the copolymer emulsion was mixed with DMF according to the procedure of Example 1, the copolymer emulsion was incompatible with the solvent, and could not be further tested. The copolymer of Comparative Example B did not contain a monomer of Group A.

Comparative Example C

A vessel was charged with 70 g of mixed perfluoroalkylethyl methacrylates (ZONYL TM, [B]), 30 g of N,N-diethylaminoethyl methacrylate [A2], and 35 g of isopropyl alcohol. The charge was purged with nitrogen at reflux for 30 min. and then cooled to 70° C. Azobis(isobutyronitrile) (VAZO 64, 1 g) was then added to initiate polymerization and the charge was stirred for 17 hours at 80–83° C. under nitrogen. The charge was cooled to 50° C. and a mixture of 13 g of glacial acetic acid and 250 g of water was added. The charge was held at 50° C. for 1 hour with agitation. The isopropanol was then stripped off by vacuum distillation. A total of 293 g of fluorocopolymer solution was obtained with a solids content of 34%.

When a portion of the fluorocopolymer solution was mixed with DMF according to the procedure of Example 1, the fluorocopolymer was compatible with the solvent, giving a clear yellow solution. This DMF-containing fluoropolymer solution was then mixed with a solution of polyurethane resin in DMF, coated on glass and then dried as described in Example 1. The sample passed the oil repellency test with a rating of 3. However, the measured receding water contact angle was 41° and the sample failed the dynamic water repellency test. This Comparative Example, lacking a monomer from Group C, D, or E demonstrated the importance of an additional monomer from Group C, D, or E.

Comparative Example D

A top coating formulation was prepared according to the procedure of Example 1 except that no monomer B component was used, and the monomer C component was a mixture of X-24-8201 ([C2], see Materials above) 50 g, stearyl methacrylate [C1] 22.5 g, and monomer components A and D were as in Example 1. The polymer latex weighed 282 g and had a solids content of 26.8%. The top coating was prepared as in Example 1 and tested on glass. The test results were:

| | |
|---|---|
| Oil repellency (Test Method #1) | 1 |
| Dynamic water repellency (Test Method #2) | Fail |
| Water receding angle (Test Method #3) | 70° |

Comparative Example E

A top coating formulation was prepared according to the procedure of Example 1 except that no monomer B component was used, and the monomer C component was X-24-8201 ([C2] see Materials above) 150 g and monomer component A and D were as in Example 1. The polymer latex weighed 358 g and had a solids content of 44.8%. The top coating was prepared as in Example 1 and tested on glass. The test results were:

| | |
|---|---|
| Oil repellency (Test Method #1) | 0 |
| Dynamic water repellency (Test Method #2) | Fail |
| Water receding angle (Test Method #3) | 0° |

Comparative Example F

A top coating formulation was prepared according to the procedure of Example 1 except that no monomer B component was used, and the monomer C component was stearyl methacrylate [C1] 52 g and monomer component A and D were as in Example 1. The polymer latex weighed 257 g and had a solids content of 23.9%. The top coating was prepared as in Example 1, however it was not possible to draw a film and no Test Method results could be made.

Comparative Examples D, E, and F demonstrated that monomer component B is required to produce useable films with the necessary performance.

What is claimed is:

1. A composition for coating synthetic grain leather comprising 1) i) a copolymer in solvent, said solvent comprising dimethylformamide or dimethylformamide mixed with up to 30% by weight other solvent, prepared by polymerization of at least one monomer A, at least one monomer B, and at least one monomer selected from the group consisting of monomer C, monomer D and monomer E, or ii) a blend of at least two of said copolymers, or iii) a blend of at least one of the above copolymers with at least one copolymer formed from at least one monomer A, at least one monomer C, and at least one monomer selected from the group consisting of monomer D and monomer E wherein monomer A is selected from the group consisting of Formula A1, Formula A2, and Formula A3, or a mixture thereof, wherein Formula A1 is $$MO[(CHR^1)_x(CH_2)_yO]_z—(CH_2)_w—(T)_v—C(O)—CR=CH_2 \quad \text{(Formula A1)}$$

wherein

M is H or $CH_3(CH_2)_r$—, wherein r is 0 to 5, (x+y) is 2 to 6 wherein x is zero or a positive integer and y is a positive integer, $R^1$ is hydrogen, fluorine, or an optionally halogenated $C_1$ or $C_2$ alkyl group, z is 3 to 22 or mixtures thereof, v is 0 or 1, w is 0 to 6, provided that when w is 0, v is 0;

T is —O— or —$NR^2$—, wherein $R^2$ is $CH_3(CH_2)_q$ and q is 0 to 4, and

R is hydrogen or a $C_1$– to $C_4$ alkyl group;

Formula A2 is $$(R^3R^4)N—(CH_2)_b—A—C(O)—CR=CH_2 \quad \text{(Formula A2)}$$

wherein $R^3$ and $R^4$ are independently $C_1$ to $C_4$ alkyl, hydroxyethyl, benzyl, or $R^3$ and $R^4$ together with the nitrogen atom form a ring structure morpholine, pyrrolidine or piperidine, b is 2 to 8 or mixtures thereof, A is —O— or —NR—, where $R^2$ is as defined above, and R is as defined above; and Formula A3 is $$X^{-+}N(R^3R^4R^5)—(CH_2)_b—A—C(O)—CR=CH_2 \quad \text{(Formula A3)}$$

wherein $R^5$ is H, $C_1$ to $C_4$ alkyl and $R^3$ and $R^4$ are as described above or $R^3$, $R^4$ and $R^5$ together with the nitrogen atom form an aromatic ring pyridine, X is a chloride, bromide, hydroxide, sulfate or carboxylate anion, and b, A, and R are as described above;

monomer B is a linear or branched fluoroalkyl (meth) acrylate of Formula B $$C_gF_{(2g+1)}—Z—O—C(O)—CR=CH2 \quad \text{(Formula B)}$$

wherein g is 4 to 20 or mixtures thereof,

R is as previously defined, and

Z represents the grouping

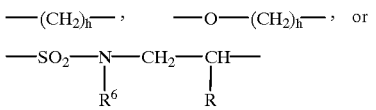

wherein h is 1 to 4, and

R is as previously defined, and $R^6$ is a $C_1$ to $C_4$ alkyl group;

monomer C is selected from the group consisting of Formula C1 and Formula C2, or a mixture thereof, wherein Formula C1 is $$C_pH_{(2p+1)}—T—C(O)—CR=CH_2 \quad \text{(Formula C1)}$$

wherein p is 4 to 22 or mixtures thereof, and

R and T are as previously defined; and

Formula C2 is $$R^6—[Si(R^6R^7)—O]_m—[Si(R^6)_2—O]_n—[(CH2)_d—O]_e—C(O)—CR=CH_2 \quad \text{(Formula C2)}$$

wherein each $R^6$ is independently a $C_1$ to $C_4$ alkyl group, $R^7$ is $R^6$ or a $C_1$ to $C_{20}$ halogenated alkyl group, (m+n) is 4 to 40 wherein m is zero or a positive integer and n is a positive integer, d is 0 to 8, e is zero or 1, provided that when d is zero, e is zero, and R is as defined above;

monomer D is a cross-linking agent;

monomer E is vinyl chloride or vinylidene chloride; and 2) a polyurethane resin in solvent, said solvent comprising dimethylformamide or dimethylformamide mixed with up to 30% by weight other solvent.

2. A composition of claim 1 wherein the copolymer is prepared by polymerization of at least one monomer of Formula A1, at least one monomer of Formula B, at least one monomer of Formula C1 and at least one monomer of Formula D.

3. A composition of claim 2 further comprising at least one monomer of Formula E.

4. A composition of claim 1 wherein monomer C is stearyl methacrylate or stearyl acryhlate.

5. A composition of claim 4 wherein for monomer A, x is 0, y is 2, z is 5 to 10 and R is hydrogen or methyl.

6. A composition of claim 5 wherein for monomer B, g is 4 to 14, Z is $(CH_2)_2$, and R is hydrogen, or mixtures thereof.

7. A composition of claim 6 wherein monomer D is at least of the of hydroxyethylmethacrylate, N-methylolacrylamide, or N-methylolomethacrylamide.

8. A method of treating synthetic grain leather comprising application to the top surface thereof an effective amount of a composition comprising 1) i) a copolymer in solvent, said solvent comprising dimethylformamide or dimethylformamide mixed with up to 30% by weight other solvent, prepared by polymerization of at least one monomer A, at least one monomer B, and at least one monomer selected from the group consisting of monomer C, monomer D and monomer E, ii) a blend of at least two of said copolymers, or iii) a blend of at least one of the above copolymers with at least one copolymer formed from at least one monomer A, at least one monomer C, and at least one monomer selected from the group consisting of monomer D and monomer E, wherein monomer A is selected from the group consisting of Formula A1, Formula A2, and Formula A3, or a mixture thereof, wherein Formula A1 is $$MO[(CHR^1)_x(CH_2)_yO]_z—(CH_2)_w—(T)_v—C(O)—CR=CH_2 \quad \text{(Formula A1)}$$

wherein

M is H or $CH_3(CH_2)_r$—, where r is 0 to 5, (x+y) is 2 to 6 wherein x is zero or a positive integer and y is a positive integer, $R^1$ is hydrogen, fluorine, or an optionally halogenated $C_1$ or $C_2$ alkyl group, z is 3 to 22 or mixtures thereof, v is 0 or 1, w is 0 to 6, provided that when w is 0, v is 0; and T is —O— or —$NR^2$—, wherein $R^2$ is $CH_3(CH_2)_q$ and q is 0 to 4, and R is hydrogen or a $C_1$–to $C_4$ alkyl group, Formula A2 is $$(R^3R^4)N—(CH_2)_b—A—C(O)—CR=CH_2 \quad \text{(Formula A2)}$$

wherein $R^3$ and $R^4$ are independently $C_1$ to $C_4$ alkyl, hydroxyethyl, benzyl, or $R^3$ and $R^4$ together with the nitrogen atom form a ring structure morpholine, pyrrolidine or piperidine.

b is 2 to 8 or mixtures thereof,

A is —O— or —$NR^2$—, wherein $R^2$ is as defined above, and

R is as defined above; and

Formula A3 is $$X^{-+}N(R^3R^4R^5)—(CH_2)_b—A—C(O)—CR=CH_2 \quad \text{(Formula A3)}$$

wherein $R^5$ is H, $C_1$ to $C_4$ alky, $R^3$, and $R^4$ are as described above, or $R^3$, $R^4$ and $R^5$ together with the nitrogen atom form an aromatic ring pyridine, X is a chloride, bromide, hydroxide, sulfate or carboxylate anion, and b, A, and R are as described above;

monomer B is a linear or branched fluoroalkyl (meth) acrylate of Formula B $$C_gF_{(2g+1)}—Z—O—C(O)—CR=CH2 \quad \text{(Formula B)}$$

wherein g is 4 to 20 or mixtures thereof,

R is as previously defined, and

Z represents the grouping

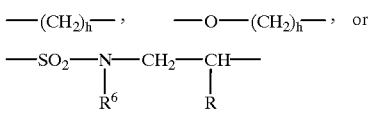

wherein h is 1 to 4, and

R is as previously defined, and $R^6$ is a $C_1$ to $C_4$ alyl group;

monomer C is selected from the group consisting of Formula C1 and Formula C2, or a mixture thereof, wherein Formula C1 is $$C_pH_{(2p+1)}—T—C(O)—CR=CH_2 \quad \text{(Formula C1)}$$

wherein p is 4 to 22 or mixtures thereof,

R and T are as previously defined; and

Formula C2 is $$R^6—[Si(R^6R^7)—O]_m—[Si(R^6)_2—O]_n—[(CH2)_d—O]_e—C(O)—CR=CH_2 \quad \text{(Formula C2)}$$

wherein each $R^6$ is independently a $C_1$ to $C_4$ alkyl group, $R^7$ is $R^6$ or a $C_1$ to $C_{20}$ halogenated alkyl group, (m+n) is 4 to 40 wherein m is zero or a positive integer and n is a positive integer, d is 0 to 8, e is zero or 1, provided that when d is zero, e is zero, and R is as defined above;

monomer D is a cross-linking agent;

monomer E is vinyl chloride or vinylidene chloride; and 2) a polyurethane resin in solvent, said solvent comprising dimethylformamide or dimethylformamide mixed with up to 30% by weight other solvent.

9. The method of claim 8 wherein the leather after treating has a preceding water contact angle of a minimum of 80°.

* * * * *

UNITED STATES PATENT AND TRADEMARK OFFICE

CERTIFICATE OF CORRECTION

PATENT NO. : 6,353,051 B1
DATED : March 5, 2002
INVENTOR(S) : Hsu-Nan Huang

It is certified that error appears in the above-identified patent and that said Letters Patent is hereby corrected as shown below:

Column 18,
Line 45, delete "-NR-" and substitute therefor -- $-NR^2-$ --.

Column 20,
Line 54, delete "$C_gF_{(2g+1)}$-Z-O-C(O)-CR=CH2" and substitute therefore -- $C_gF_{(2g+1)}$-Z-O-C(O)-CR=$CH_2$ --.

Column 22,
Line 16, delete "preceding" and substitute therefor -- receding --.

Signed and Sealed this

First Day of October, 2002

*Attest:*

*Attesting Officer*

JAMES E. ROGAN
*Director of the United States Patent and Trademark Office*